US007407039B2

(12) United States Patent
Bailey

(10) Patent No.: US 7,407,039 B2
(45) Date of Patent: Aug. 5, 2008

(54) PORTABLE HOIST LIFTING FRAME KIT

(75) Inventor: Michael Bailey, 11, Marsh Meadow, Adbaston, Staffs (GB) ST20 0QE

(73) Assignee: Michael Bailey, Adbaston, Stafford (GB)

( * ) Notice: Subject to any disclaimer, the term of this patent is extended or adjusted under 35 U.S.C. 154(b) by 391 days.

(21) Appl. No.: 10/650,734

(22) Filed: Aug. 29, 2003

(65) Prior Publication Data

US 2004/0124326 A1 Jul. 1, 2004

(51) Int. Cl.
*B66B 9/16* (2006.01)

(52) U.S. Cl. ..... 187/240; 187/241; 187/242; 248/327; 212/179

(58) Field of Classification Search ..... 248/327; 187/240, 242, 244, 243; 212/179; 254/334, 254/323

See application file for complete search history.

(56) References Cited

U.S. PATENT DOCUMENTS 4,706,939 A 11/1987 Gagne
4,795,136 A 1/1989 Haefner
5,310,066 A * 5/1994 Konstant ..... 211/193
5,310,152 A * 5/1994 O'Neill ..... 248/329
6,135,300 A * 10/2000 Fox ..... 212/179
6,920,963 B2 * 7/2005 Faller ..... 187/406

FOREIGN PATENT DOCUMENTS

| | | |
|---|---|---|
| GB | 2273090 | 6/1994 |
| GB | 2340102 | 2/2000 |
| JP | 8303820 | 11/1996 |
| JP | 200034837 | 2/2000 |

* cited by examiner

*Primary Examiner*—Patrick Mackey
*Assistant Examiner*—Terrell Matthews

(57) ABSTRACT

A portable hoist lifting frame kit has a cross beam 12 that can support an electrically, mechanically, hydraulically or pneumatically operated hoist. The cross beam is secured to or supported by cantilever arms 9 which in turn locate into extension arms 4. The cross beam can move laterally along the length of the cantilever arms. The extension arms locate into protrusion blocks which in turn locate into a wall mounted bracket support system designed to support the load to be raised. The bracket support system is of the mild steel channel type with return lip such as "unistrut". The portable hoist lifting frame kit can be assembled in various configurations i.e. it can be used with or without the protrusion blocks and extension arms.

15 Claims, 4 Drawing Sheets

PORTABLE HOIST LIFTING FRAME KIT

CROSS REFERENCE TO RELATED APPLICATIONS

This invention relates to a portable hoist lifting frame kit and claims the benefit of a prior UK filing, application no. GB 0220408.9, filing date: 3 Sep. 2002.

STATEMENT REGARDING FEDERALLY SPONSORED RESEARCH OR DEVELOPMENT

N/A

REFERENCE TO SEQUENCE LISTING

N/A

BACKGROUND OF THE INVENTION

Portable hoists are well known for lifting heavy items and normally comprise of some form of wheeled platform onto which is fabricated a set of movable forks or beam that have the ability to move a load vertically up or down by means of electrically or mechanically driven gearing.

Such hoists may be used within the Air Conditioning Industry to enable the outdoor unit of a "split system" herein known as the load to be raised (i.e. an air conditioning system comprising an indoor unit and an outdoor unit linked via pipe work and cabling) to be mounted onto suitable wall mounted brackets above head height. The brackets usually fabricated from mild steel channel with return lip (unistrut being just one example) consist of 2 off uprights secured to the wall by use of expandable fixings and 2 off horizontally extending arms secured to the uprights using channel nuts.

Portable hoists however, can be awkward to handle particularly on soft or uneven ground, or in places where access is difficult. They need firm level ground to operate from. Often the load is unsecured as the hoist was not designed specifically for any one particular task. In addition they are relatively expensive to purchase or alternatively involve the inconvenience and cost of having to be hired.

BRIEF SUMMARY OF THE INVENTION

According to the present invention there is provided a portable hoist lifting frame kit comprising horizontally extending protrusion blocks, vertically extending extension arms, horizontally extending cantilever arms, a cross beam and an adjustable H-frame wherein the protrusion blocks, extension arms and cantilever arms are adapted to interlock with each other.

An object of this invention is to provide a portable hoist lifting kit specifically for raising a load safely onto a wall mounted bracket support system whereby the combined mass or the portable hoist lifting frame kit and the load to be raised is supported by the bracket support system. It can be used particularly where access is limited or where soft and uneven ground conditions prevail. During the lift operation the load to be lifted is secured firmly to the lifting frame.

The portable hoist lifting frame kit which can be fabricated from steel, aluminium or other materials may be put to other related uses also.

BRIEF DESCRIPTION OF THE SEVERAL VIEWS OF THE DRAWINGS

A specific embodiment of the invention will now be described by way of example with reference to the accompanying drawings in which:—

FIGS. 6 and 7 also show the H frame secured to the load to be lifted.

DETAILED DESCRIPTION OF THE INVENTION

Figures 1, 2, 3, 4:
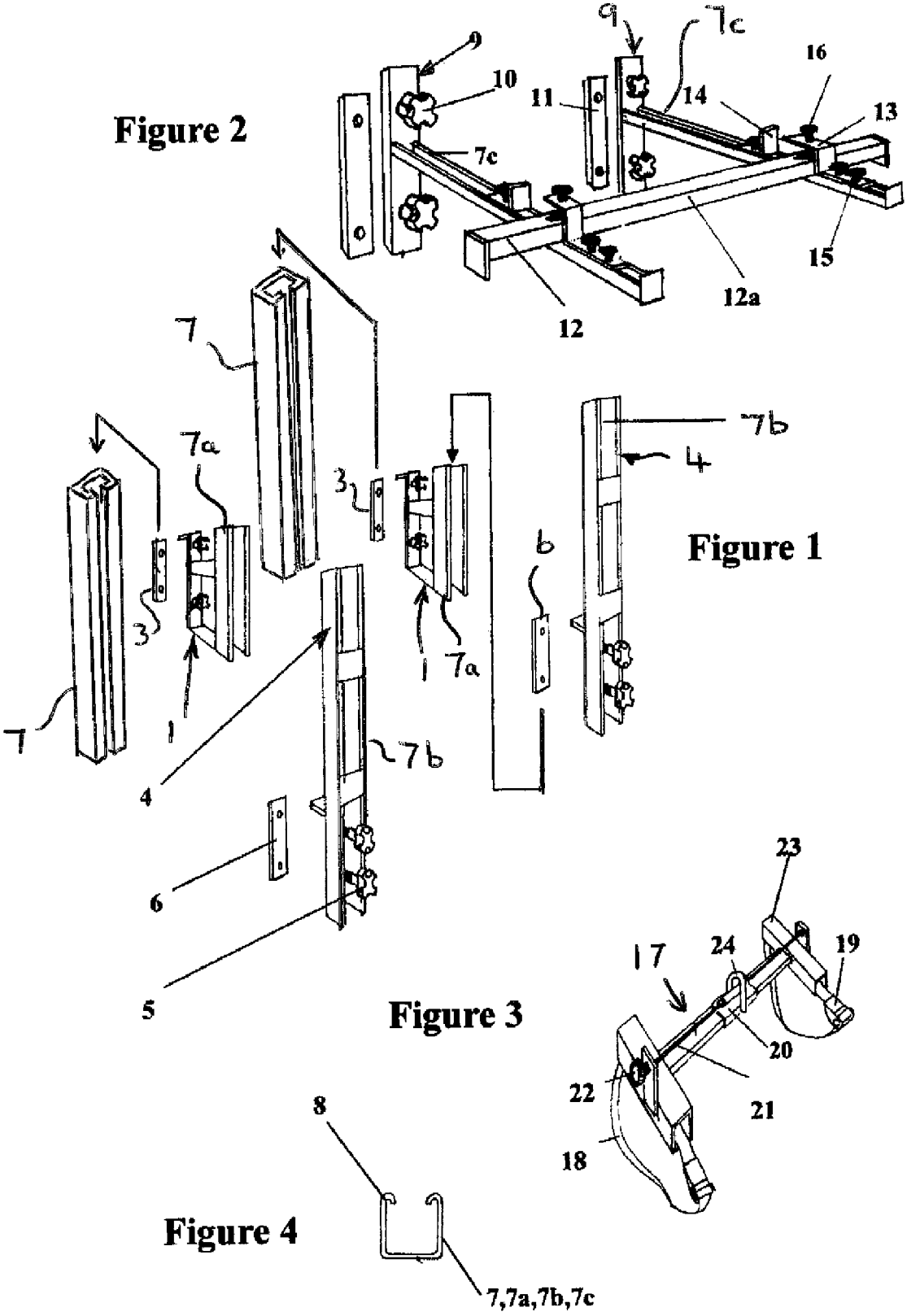
FIG. 1 shows in perspective the two protrusion blocks, the two extension arms and the wall mounting bracket channels.
FIG. 2 shows in perspective the two cantilever arm assemblies with the detachable cross beam in position.
FIG. 3 shows in perspective the adjustable H frame.
FIG. 4 shows the cross sectional profile of the wall mounting bracket system channels, and also the securing components of the protrusion blocks 7*a*, extension arms 7*b*, and cantilever arm assemblies 7*c*.

Referring to the drawings the portable hoist frame kit comprises two protrusion blocks 1 as illustrated in FIG. 1 which are slotted into the top of wall mounting bracket channels 7 that form part of an air conditioning unit's wall mounting bracket system 30. (Note; the bracket channels 7 are not part of the invention but are necessarily included in order to assist with describing the use of the invention). At this stage the bracket channels 7 will be secured to a wall 36 of a building or similar using expandable fixing 34. The distance that the bracket channels 7 are placed apart is dependent upon the width of the load to be raised 28.

The protrusion blocks 1 are secured and held in place on the bracket channels 7 using the releasable HT fixing screws 2 and channel plates 3. The channel plates 3 grip against the return lip 8 of the bracket channel 7 (see FIGS. 4 and 5*a*). The purpose of the protrusion blocks 1 is to allow the portable hoist lifting frame to clear any potential protrusions (i.e. soil pipes, storm drains, cladding etc.) when fully assembled.

Figures 5, 5A:
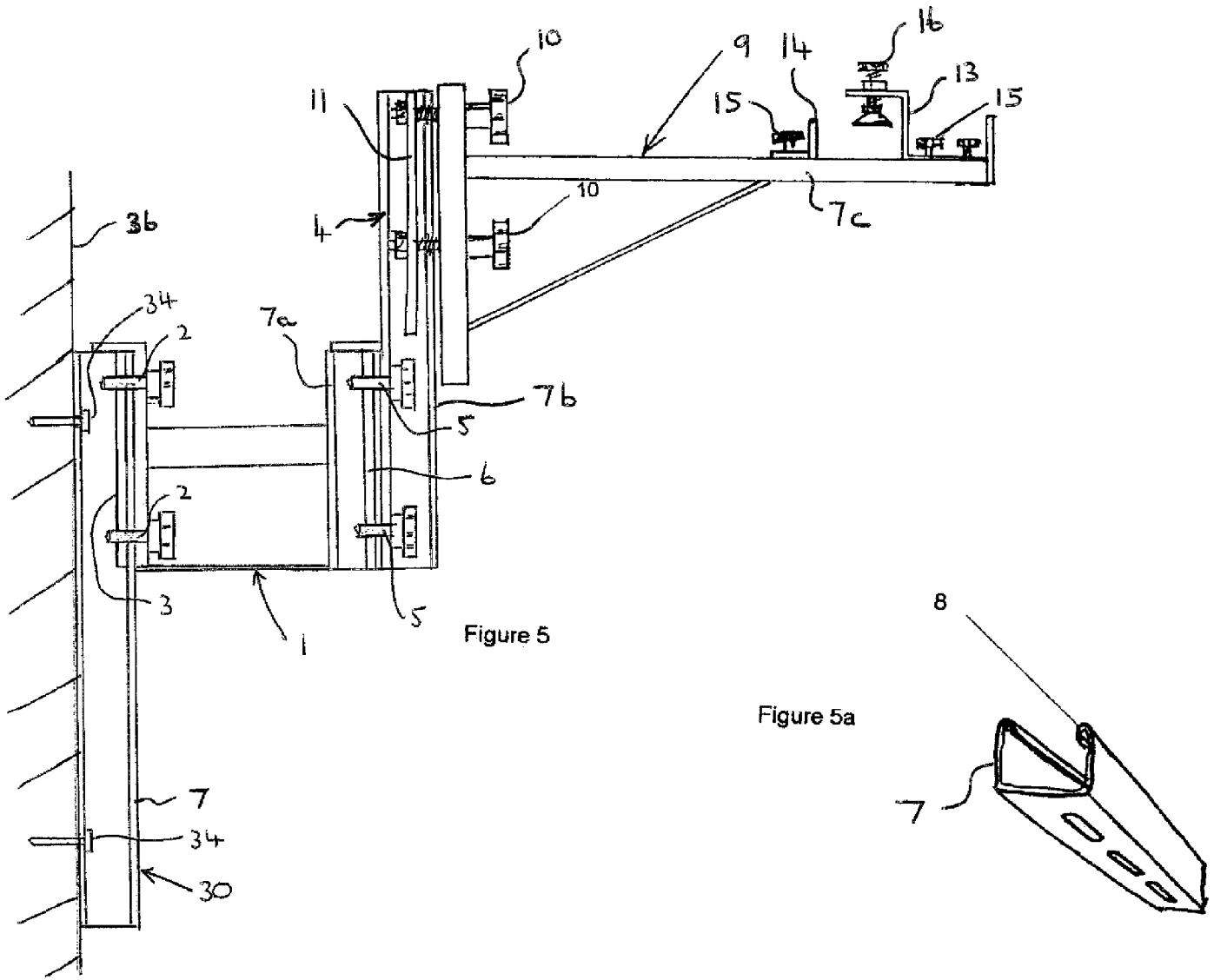
FIG. 5 shows a side elevation of a cantilever arm assembly, extension arm and protrusion block in an assembled condition mounted to a wall mounting bracket system.
FIG. 5*a* shows the perspective cross sectional view of the mounting bracket channel 7 (not part of the invention but necessary to assist in describing its use) with return lip 8 (The return lip profile is the same as that of the securing components 7*a*, 7*b*, 7*c* of the protrusion blocks 1, extension arms 4, and cantilever arm assemblies 9 respectively).
Figure 6:
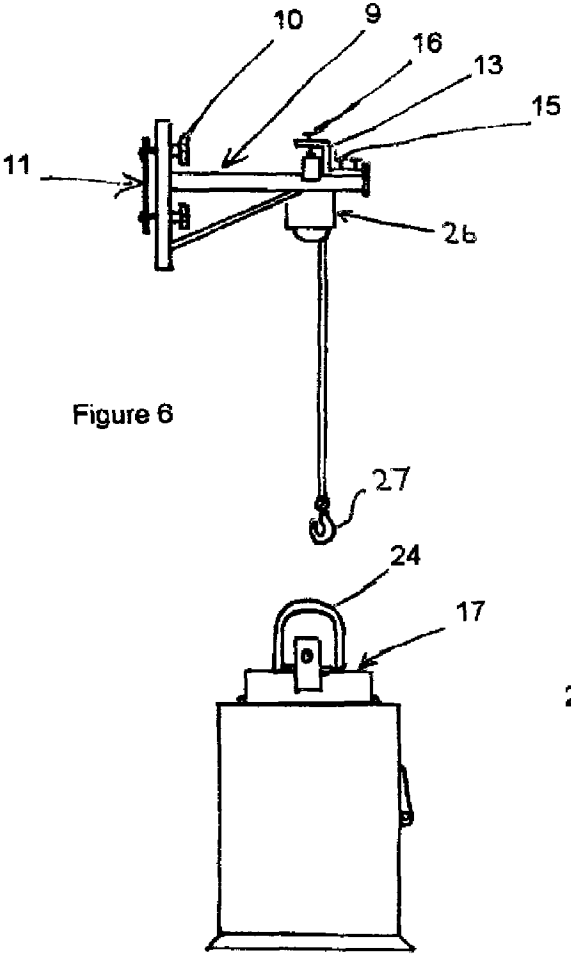

Next the cantilever arm assemblies 9 as illustrated in FIGS. 2, 5 and 6 are slotted into the extension arms 4 and secured using the releasable HT securing screws 10 and channel plates 11. The channel plates 11 grip against the return lips 8 of the extension arm securing components 7*b* as illustrated in FIG. 4. The purpose of the cantilever arm assemblies 9 is to support the cross beam 12 as illustrated in FIG. 2.

The cross beam 12 is allowed to move laterally along the top edges of the securing components 7*c* of the cantilever arm assemblies and is secured in place using beam clamping brackets 13 (one per cantilever arm assembly 9) and beam securing brackets 14 (one per cantilever arm assembly 9) as illustrated in FIGS. 2, 5 and 6. This allows the cross beam 12 to be positioned at varying distances parallel to the wall 36. The beam clamping brackets 13 and beam securing brackets 14 are secured to the securing components 7*c* of the cantilever arm assemblies 9 using knurled screw fixings 15 and small channel plates (not shown). The small channel plates (not shown) grip against the return lips 8 on the cantilever securing components 7*c* as illustrated in FIG. 4.

The cross beam 12 is prevented from moving laterally along its own axis by the clamping screws 16. The clamping screws 16 are mounted in the beam clamping brackets 13.

Figure 7:
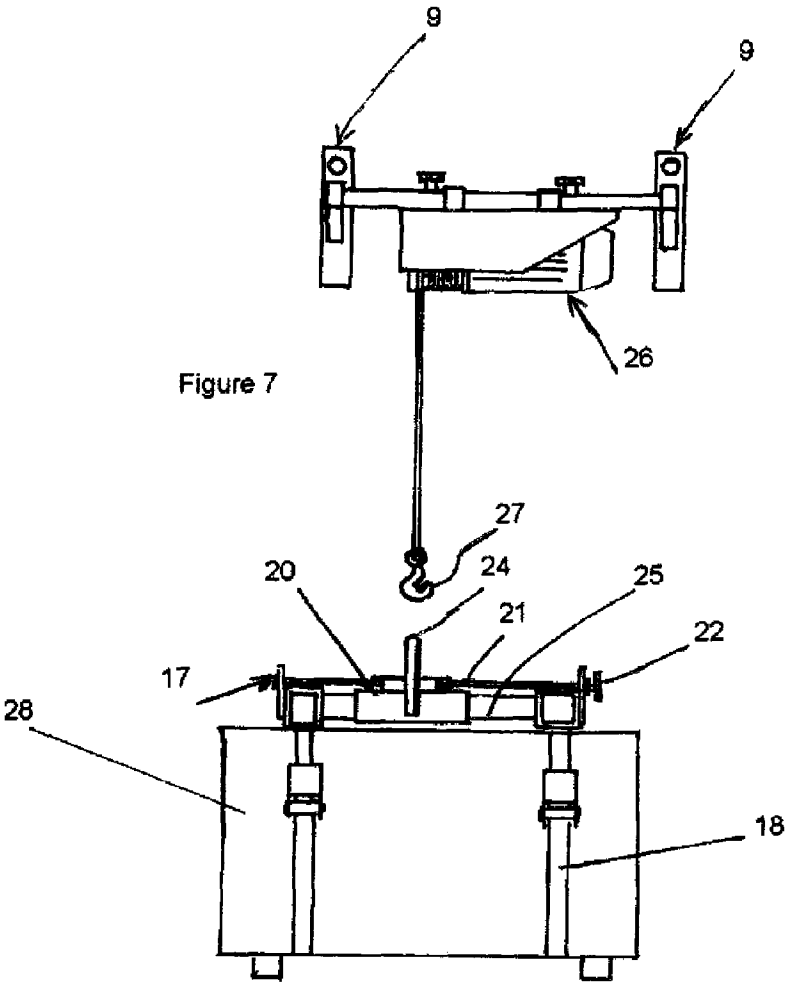
FIGS. 6 and 7 show the cantilever arm assemblies and cross beam supporting a hoist 26.
Figure 8:
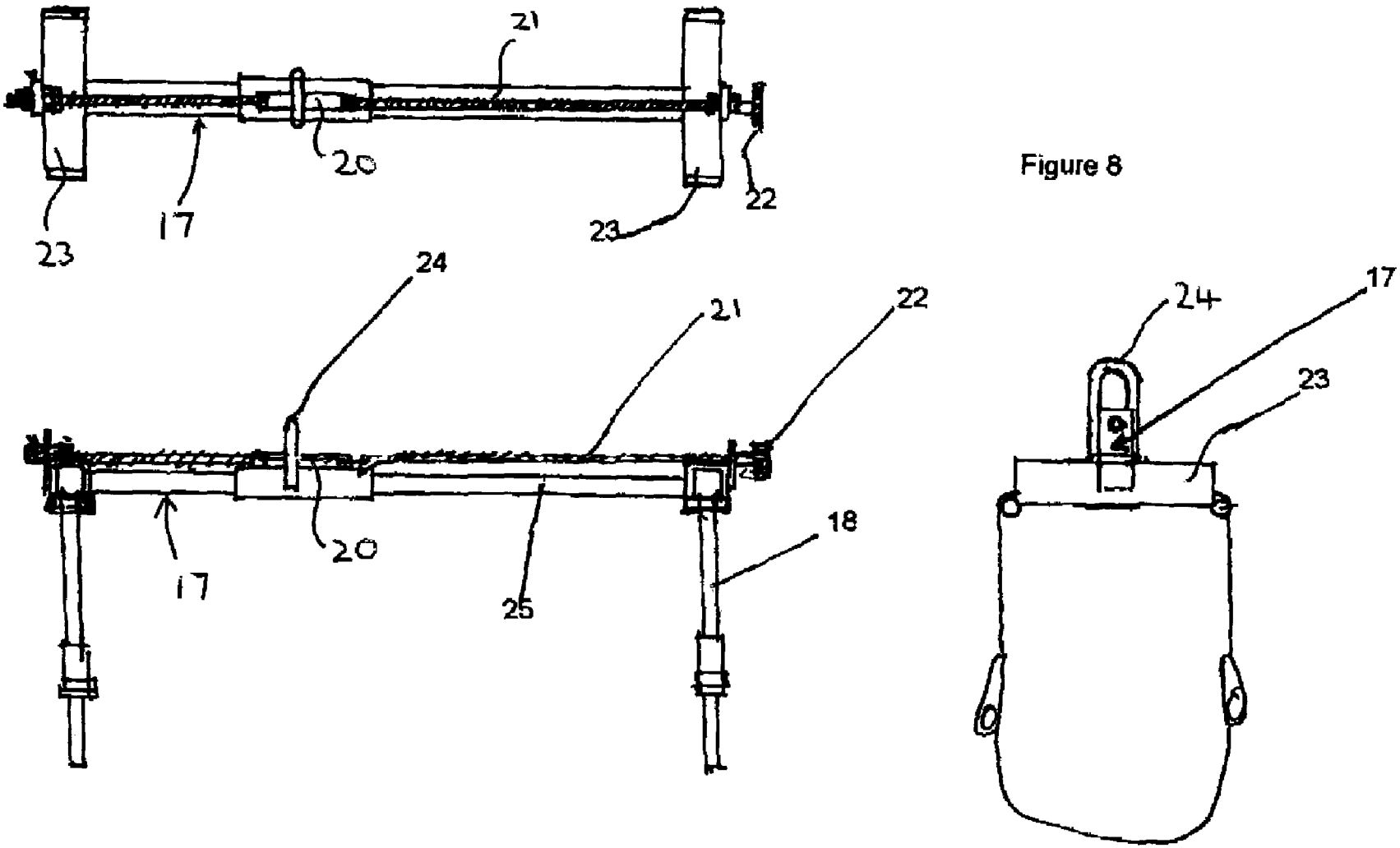
FIG. 8 shows the H frame.

FIGS. 3, 7 and 8 show the H frame 17. This is placed on top of the load to be raised 28 and secured by passing the securing straps 18 around the load to be raised 28 and tightening and securing the securing straps 18 using the ratchet mechanisms 19. The securing straps 18 pass through the square section tubes 23 of the H frame 17.

The load to be raised 28 may have an offset centre of gravity. In order to achieve a straight and level lift the H frame 17 has a moveable boss 20 which can move laterally in either direction along the spine 25 of the H frame. This is achieved via a threaded rod 21 which passes through female threads (not shown) within the boss 20. As the threaded rod 21 is rotated using the knurled knob 22 so the boss 20 is moved in either direction away from the centre of the H frame 17. Attached to the boss 20 is a lifting loop 24.

The load to be raised 28 can now be raised by attaching a hoist 26 around the cross beam 12 using the hoist's own mounting brackets.

The hook 27 of the electrically or mechanically operated hoist 26 is lowered and attaches through the loop 24 of the H frame 17. The load to be raised 28 can now be raised and the horizontally extending arms (not shown) can be fitted onto the uprights 7 of the bracket support system of the load to be raised.

On successfully mounting the load to be raised 28 onto the extending arms (not shown) of the bracket support system 30, the portable hoist frame kit is dismantled in the reverse order sequence.

The invention claimed is:

1. A portable hoist lifting frame kit comprising cantilever arm assemblies and a cross beam, the cantilever arm assemblies being adapted for mounting to a bracket support system from which a load to be raised will be supported, a hoist which is mountable to the cross beam, protrusion blocks for spacing the cantilever arm assemblies horizontally from the bracket support system, and extension arms for spacing the cantilever arm assemblies vertically from the bracket support system, the protrusion blocks and extension arms each being adapted for mounting to the bracket support system.

2. A portable hoist lifting frame kit according to claim 1, in which the kit includes an adjustable H frame.

3. A portable hoist lifting frame kit according to claim 1, in which the kit includes an adjustable H frame, the H frame including levelling means that can adapt to the center of gravity of the load to be lifted not being at the center of the H frame.

4. A portable hoist lifting frame kit according to claim 1, in which the kit includes clamping means for the cross beam.

5. A portable hoist lifting frame kit according to claim 1, in which the kit includes clamping means for the cross beam which are arranged to permit the position of the cross beam to be adjustable relative to the cantilever arms.

6. A portable hoist lifting frame kit according to claim 1, in which the kit includes clamping means for the cross beam which are arranged to permit the position of the cross beam to be adjustable longitudinally and laterally relative to the cantilever arms.

7. A portable hoist lifting frame kit comprising cantilever arm assemblies and a cross beam, the cantilever arm assemblies being adapted for mounting to a bracket support system from which the load to be raised will be supported, the kit including a hoist which is mounted to the cross beam, the kit further including clamping means for the cross beam which are arranged to permit the position of the cross beam to be adjustable relative to the cantilever arms.

8. A portable hoist lifting frame kit according to claim 7, in which the kit includes an adjustable H frame.

9. A portable hoist lifting frame kit according to claim 7, in which the kit includes an adjustable H frame, the H frame including levelling means that can adapt to the center of gravity of the load to be lifted not being at the center of the H frame.

10. A portable hoist lifting frame kit according to claim 7, in which the clamping means are arranged to permit the position of the cross beam to be adjustable longitudinally and laterally relative to the cantilever arms.

11. A portable hoist lifting frame kit comprising cantilever arm assemblies and a cross beam, the cantilever arm assemblies being adapted for mounting to a bracket support system from which a load to be raised will be supported, an adjustable H frame, protrusion blocks for spacing the cantilever arm assemblies horizontally from the bracket support system, and extension arms for spacing the cantilever arm assemblies vertically from the bracket support system, the protrusion blocks and extension arms each being adapted for mounting to the bracket support system.

12. A portable hoist lifting frame kit according to claim 11, in which the H frame includes levelling means that can adapt to the center of gravity of the load to be lifted not being at the center of the H frame.

13. A portable hoist lifting frame kit according to claim 11, in which the kit includes clamping means for the cross beam.

14. A portable hoist lifting frame kit according to claim 11, in which the kit includes clamping means for the cross beam which are arranged to permit the position of the cross beam to be adjustable relative to the cantilever arms.

15. A portable hoist lifting frame kit according to claim 11, in which the kit includes clamping means for the cross beam which are arranged to permit the position of the cross beam to be adjustable longitudinally and laterally relative to the cantilever arms.

* * * * *